US007733203B2

(12) United States Patent
Kim

(10) Patent No.: US 7,733,203 B2
(45) Date of Patent: Jun. 8, 2010

(54) AUXILIARY CONTACT UNIT FOR MAGNETIC CONTACTOR

(75) Inventor: Jun Ho Kim, Daejeon (KR)

(73) Assignee: LS Industrial Systems Co., Ltd., Seoul (KR)

( * ) Notice: Subject to any disclaimer, the term of this patent is extended or adjusted under 35 U.S.C. 154(b) by 103 days.

(21) Appl. No.: 11/566,027

(22) Filed: Dec. 1, 2006

(65) Prior Publication Data

US 2007/0188279 A1 Aug. 16, 2007

(30) Foreign Application Priority Data

Feb. 16, 2006 (KR) ..... 20-2006-0004356 U

(51) Int. Cl.
*H01H 9/02* (2006.01)
*H01H 13/04* (2006.01)
*H01H 67/02* (2006.01)

(52) U.S. Cl. ..... 335/202; 335/132

(58) Field of Classification Search ..... 335/202, 335/132

See application file for complete search history.

(56) References Cited

U.S. PATENT DOCUMENTS 3,339,161 A * 8/1967 Conner et. al. ..... 335/131
4,760,364 A * 7/1988 Ostby ..... 335/132
4,774,484 A * 9/1988 Lehman et al. ..... 335/197
5,014,027 A * 5/1991 Ootsuka ..... 333/132
5,049,846 A * 9/1991 Morgan et al. ..... 335/202
5,206,779 A * 4/1993 Sato et al. ..... 361/111
5,535,083 A * 7/1996 Sako et al. ..... 361/38
5,652,698 A * 7/1997 Eberts ..... 361/825
5,677,655 A * 10/1997 Hinata et al. ..... 335/132
6,012,683 A * 1/2000 Howell ..... 248/49
6,120,425 A * 9/2000 Endelman ..... 482/142
6,140,896 A * 10/2000 Heckenkamp ..... 335/159
6,208,228 B1 * 3/2001 Gula et al. ..... 335/172
6,556,112 B1 * 4/2003 Van Zeeland et al. ..... 335/205
6,624,731 B2 * 9/2003 Passow et al. ..... 335/202
6,784,770 B2 * 8/2004 Gimenez et al. ..... 335/18
2005/0003860 A1 * 1/2005 Jung ..... 455/557
2005/0048829 A1 * 3/2005 Nishio et al. ..... 439/331
2005/0156696 A1 * 7/2005 Sakai et al. ..... 335/78
2005/0200439 A1 * 9/2005 Kawahara et al. ..... 335/128

* cited by examiner

*Primary Examiner*—Elvin G Enad
*Assistant Examiner*—Alexander Talpalatskiy
(74) *Attorney, Agent, or Firm*—Lee, Hong, Degerman, Kang & Waimey

(57) ABSTRACT

An auxiliary contact unit for a magnetic contactor is disclosed, wherein the auxiliary contact unit is disposed at an inner lower frame thereof with a cover connected to lower hooks and supporting an upper structure, and the cover is supported at a lower surface thereof by a protrusion.

12 Claims, 7 Drawing Sheets

AUXILIARY CONTACT UNIT FOR MAGNETIC CONTACTOR

This application is based on and claims priority to Korean Patent Application No. 20-2006-0004356 filed on Feb. 16, 2006 in the Korean Intellectual Property Office (KIPO), the entire contents of which are hereby incorporated by reference.

BACKGROUND OF THE INVENTION

1. Field of the Invention

The present invention relates to an auxiliary contact unit for a magnetic contactor, and more particularly, to an auxiliary contact unit securely attachable to a magnetic contactor.

2. Description of the Conventional Art

Generally, a magnetic contactor is connected to a wire connected to a system, and opens and closes a circuit on the system. An auxiliary contact unit is used along with the magnetic contactor and functions to open and close a weak current or a low level current employed for, for example, a control signal.

The auxiliary contact unit is typically attachable to a lateral surface or an upper surface of the magnetic contactor, and a certain magnetic contactor has a built-in auxiliary contact unit. A movable unit of an auxiliary contact unit is attached to a magnetic contactor and at the same time is connected to a movable unit of the magnetic contactor to open and close a contact point of the auxiliary contact unit in response to opening/closing operation of the magnetic contactor, and to turn on and turn off the current flowing in the auxiliary contact unit.

One of the methods of attaching an auxiliary contact unit to a magnetic contactor is a snap-fit connection method, but, in order to obtain a secure attachment, a screw or a bolt/nut are used. Regardless of the attachment methods, an auxiliary contact unit must be securely attached to a magnetic contactor in order to withstand or absorb vibrations and shocks that might be involved with opening and closing of the magnetic contactor.

Hereunder, configuration of the conventional auxiliary contact unit, and an attachment method of an auxiliary contact unit to a magnetic contactor will be described with reference to the accompanying drawings.

FIG. 1 is a perspective view illustrating a magnetic contactor attached with an auxiliary contact unit according to prior art. FIG. 2 is a schematic diagram illustrating an auxiliary contact unit according to the prior art, and FIG. 3 is a perspective view illustrating a conventional magnetic contactor.

Referring to FIG. 1, a magnetic contactor (10) is attached at one side thereof with an auxiliary contact unit (20), where the auxiliary contact unit is attached across a part of an upper frame and a lower frame of the magnetic contactor. At this time, the auxiliary contact unit (20) is equipped with a plurality of hooks and lugs at an attachment frame thereof to which the magnetic contactor (10) is attached, as shown in FIG. 2.

In other words, a frame of the auxiliary contact unit (20) is lengthwise provided at an upper surface thereof with a cross-bar lug insertion groove (22) from which a cross-bar lug (21) of the auxiliary contact unit (20) is protruded for vertical movement, and the cross-bar lug insertion groove (22) is formed at left and right sides thereof with upper hooks (23). Furthermore, the frame of the auxiliary contact unit (20) is provided at left and right lower surfaces thereof with fixed lugs (25) and further down there are formed with lower hooks (27).

Referring now to FIG. 3, the magnetic contactor (10) is formed with grooves at positions corresponding to the plurality of hooks and lugs provided at the auxiliary contact unit (20). In other words, upper hook insertion grooves (13) into which the cross-bar insertion groove (11) and the upper hooks (23) are inserted are formed at an upper frame of the magnetic contactor (10), while fixed lug insertion grooves (15) into which the fixed lugs (25) of the auxiliary contact unit (20) are inserted, and lower hook insertion grooves (17) into which the lower hooks (27) are inserted, are formed at a lower frame of the magnetic contactor (10).

Accordingly, the auxiliary contact unit (20) can be attached to the magnetic contactor (10) by inserting the cross-bar lug (21) inserted into an interior of the auxiliary contact unit (20) into the cross-bar lug insertion groove (11) of the magnetic contactor (10), and inserting the upper hooks (23), the fixed lugs (25) and the lower hooks (27) into the upper hook insertion grooves (13), the fixed lug insertion grooves (15) and the lower hook insertion grooves (17) respectively.

At this time, the auxiliary contact unit (20) can be easily attached to the magnetic contactor (10) by the elastic force of a compression spring disposed at a lower inside thereof, the detailed explanation of which will be given with reference to FIGS. 4*a* and 4*b*.

FIG. 4*a* is a lower horizontal cross-sectional view of an auxiliary contact unit according to prior art, FIG. 4*b* is a schematic view of a spring cover and a lower hook applied to an auxiliary contact unit according to the prior art and FIG. 4*c* is a schematic view in which the spring cover of FIG. 4*a* is removed.

Throughout the drawings, elements, parts or portions similar to or corresponding to those in FIG. 1 to FIG. 3 are designated by like reference numerals.

As illustrated in the drawings, the lower hooks (27) are connected to a cover (28), and the cover (28) is installed thereunder with a compression spring (29). The auxiliary contact unit (20) can be easily attached to the magnetic contactor (10) by inserting the lower hooks (27) of the auxiliary contact unit (20) to the lower hook insertion grooves (17) of the magnetic contactor (10) and using the elastic force of the cover (28) and the compression spring (29).

However, the conventional auxiliary contact unit attachable according to the above method suffers from a number of shortcomings that make it inefficient, for example but not limited thereto, in retaining attachment force thereof.

In other words, although the compression spring facilitates the attachment of the auxiliary contact unit to the magnetic contactor, and serves to support an auxiliary contact and protects the auxiliary contact against shocks or vibrations caused by continued ON/OFF operations of the magnetic contactor, the elastic force of the compression spring comes to deteriorate as time passes and the ON/OFF operations continue, thereby weakening the support strong enough to retain the attachment force of the auxiliary contact unit.

SUMMARY OF THE INVENTION

The present invention is disclosed to solve the aforementioned problems and it is an object of the present invention to provide an auxiliary contact unit for a magnetic contactor adapted to replace a compression spring with an elastic protrusion and let it to support a cover, thereby minimizing deterioration of the attachment force of the auxiliary contact unit at the magnetic contactor as time passes and the ON/OFF operations of the magnetic contactor continue.

To achieve these and other advantages and in accordance with the purpose of the present invention, as embodied and broadly described herein, there is provided an auxiliary contact unit for a magnetic contactor, comprising: a cover disposed inside a lower frame of the auxiliary contact unit, and connected to lower hooks supporting an upper structure; and a protrusion formed either at a lower end surface of the cover or a bottom surface of the lower frame for supporting a lower surface of the cover.

Preferably, the protrusion is so disposed as to support a central lower end surface of the cover, and more preferably, at least more than two protrusions are disposed on the lower end surface of the cover, each protrusion spaced a predetermined distance apart, so that force can be equally distributed. The protrusion is preferred to be made of elastic material.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE INVENTION

Reference will now be made in detail to the preferred embodiments of the present invention, examples of which are illustrated in the accompanying drawings. Hereinafter, an auxiliary contact unit for a magnetic contactor according to the present invention will be described with reference to the attached drawings.

Figure 1:
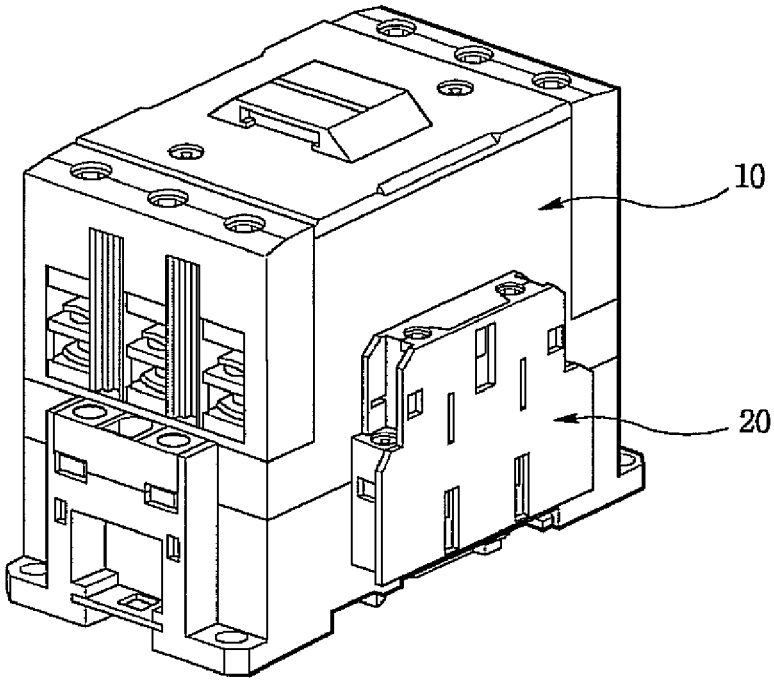
FIG. 1 (PRIOR ART)
FIG. 1 is a perspective view of a magnetic contactor attached with an auxiliary contact unit according to prior art.
Figure 2:
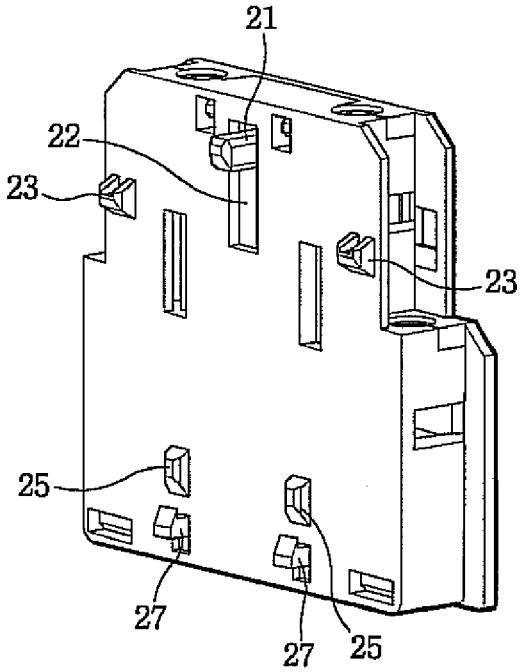
FIG. 2 (PRIOR ART)
FIG. 2 is a schematic view of an auxiliary contact unit according to prior art.
Figure 3:
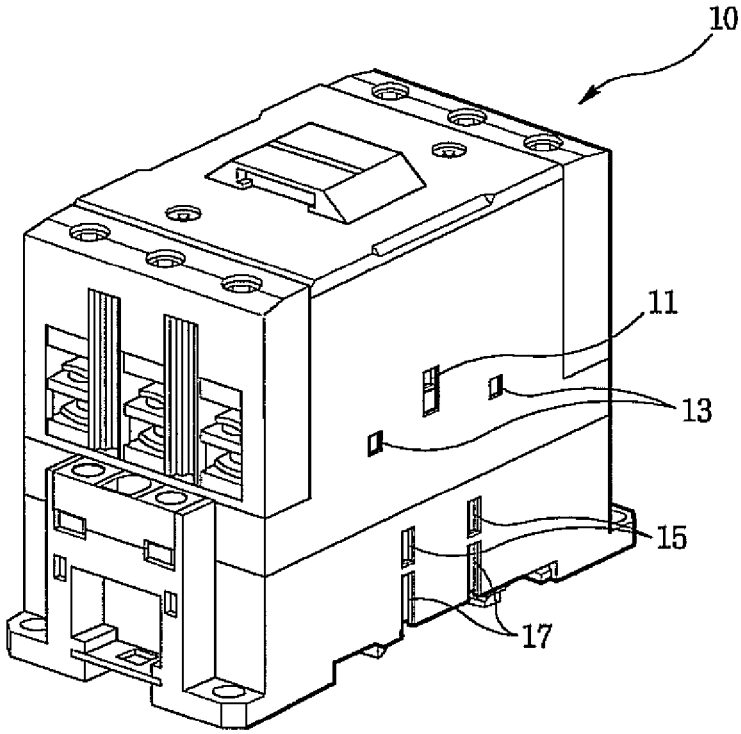
FIG. 3 (PRIOR ART)
FIG. 3 is a perspective view of a conventional magnetic contactor.
Figure 4A:
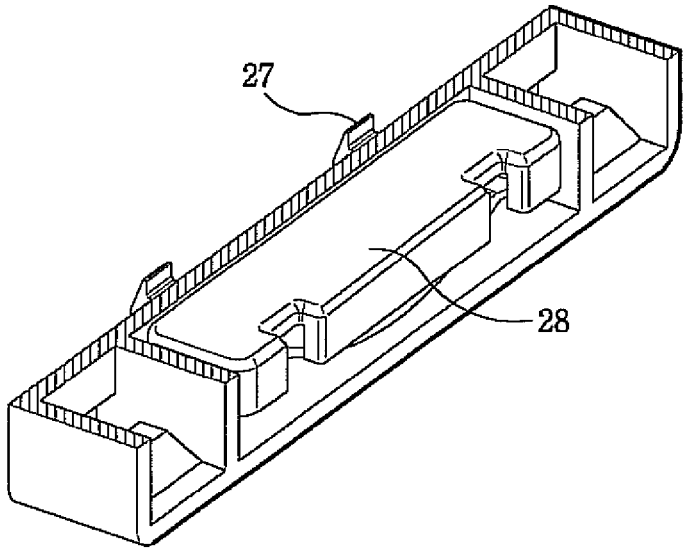
FIG. 4a (PRIOR ART)
FIG. 4*a* is a longitudinal cross-sectional view of a lower part of an auxiliary contact unit according to the prior art.
Figure 4B:
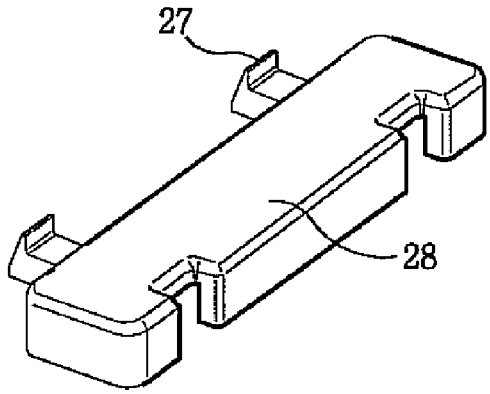
FIG. 4b (PRIOR ART)
FIG. 4*b* is a schematic view of a spring cover and a lower hook employed for the conventional auxiliary contact unit.
Figure 4C:
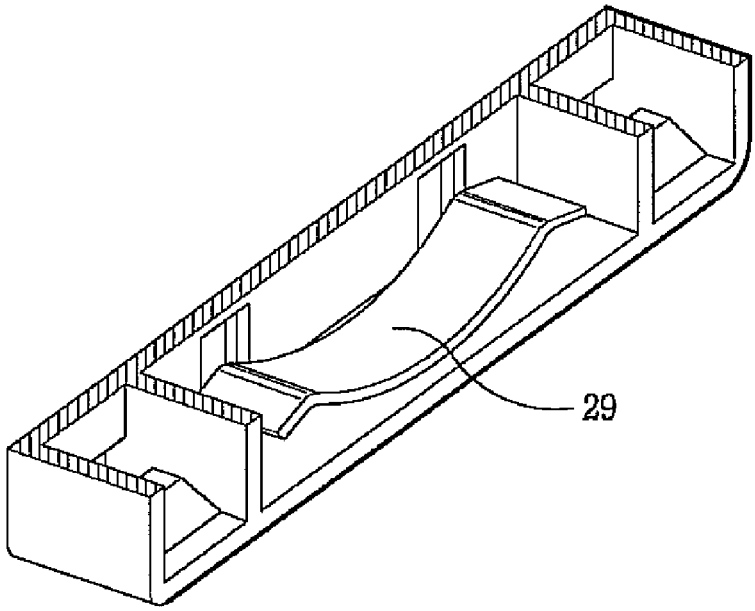
FIG. 4c (PRIOR ART)
FIG. 4*c* is a schematic view of FIG. 4*a* where the spring cover is removed.
Figure 5A:
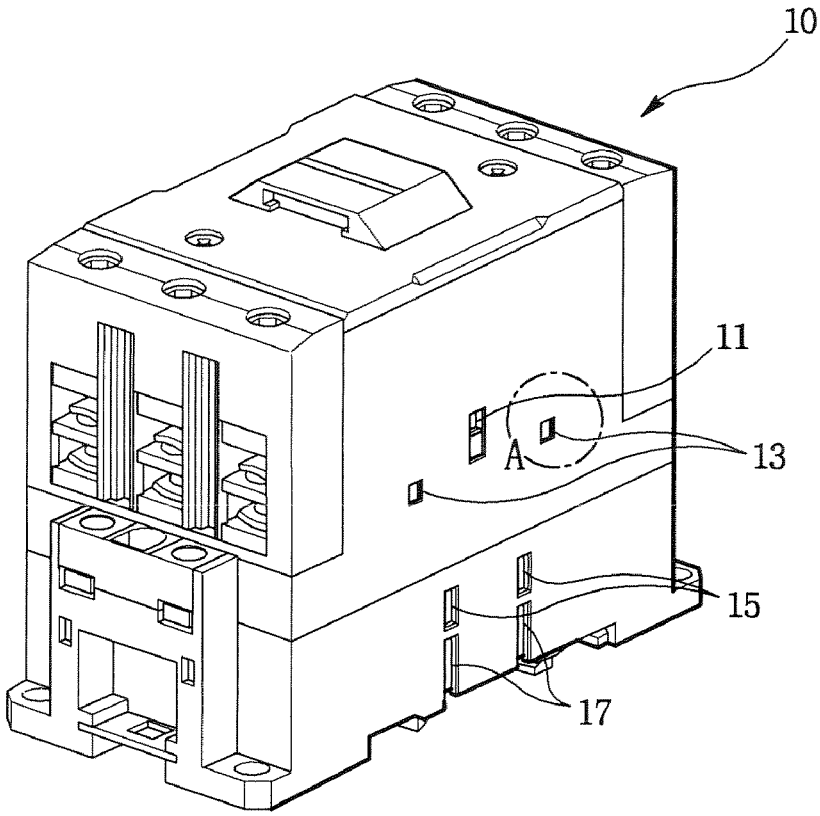
FIG. 5*a* is an enlarged lateral view of an attachment surface of a magnetic contactor on which an auxiliary contact unit according to the present invention is attached and having upper hook insertion grooves, one of the upper hook insertion grooves located in area A.
Figure 5B:
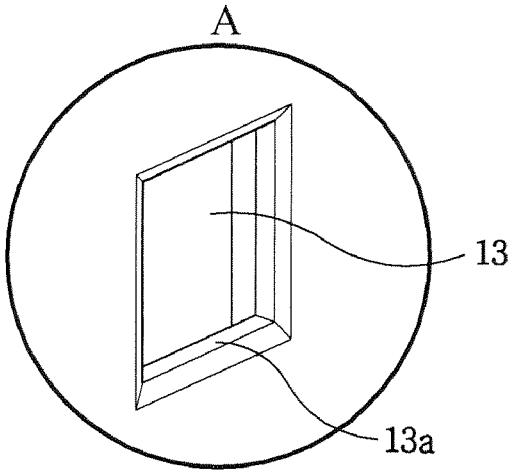
FIG. 5*b* is an enlarged view of area A shown in FIG. 5*a* illustrating the upper hook insertion groove.

FIG. 5*a* is an enlarged lateral view of an attachment surface of a magnetic contactor on which an auxiliary contact unit according to the present invention is attached and upper hook insertion grooves, and FIG. 5*b* is a partial cut-away view of a lower frame of a magnetic contactor to which an auxiliary contact unit according to the present invention is attached and an enlarged view of an upper hook insertion groove. Hereinafter, elements, parts or portions similar to or corresponding to those in FIG. 1 to FIG. 4 are designated by like reference numerals.

Referring to FIG. 5*a*, a magnetic contactor (10) is formed at an upper frame thereof with upper hook insertion grooves (13) into which upper hooks (23) disposed at an auxiliary contact unit (20) are inserted, and a cross-bar lug insertion groove (11) into which a cross-bar lug (21) is inserted. The magnetic contactor (10) is further formed at a lower frame thereof with lower hook insertion grooves (17) into which lower hooks (27) of the auxiliary contact unit (20) are inserted, and fixed lug insertion grooves (15) into which fixed lugs (25) are inserted.

Now, referring to FIG. 5*b*, which is an enlarged view of area A shown in FIG. 5*a*, each upper hook insertion groove (13) is formed therein with an inclined surface (13*a*), the shape of which corresponds to that of the upper hook so that the upper hook is prevented from being easily unhooked from the upper hook insertion groove (13) once the upper hook is inserted into the groove.

Figure 5C:
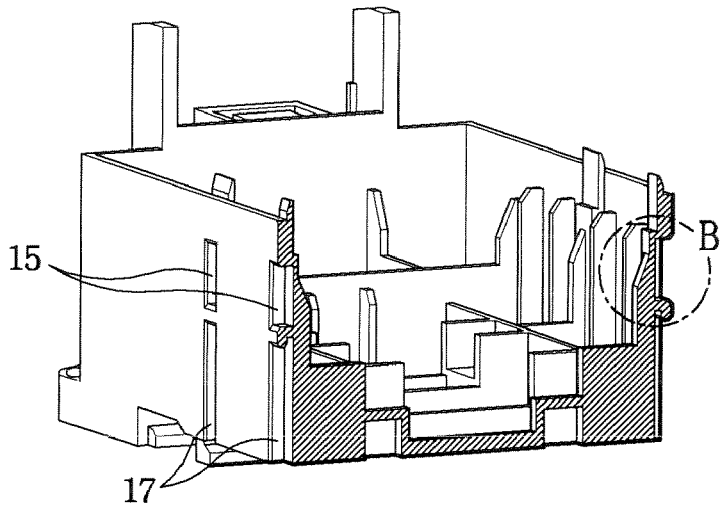
FIG. 5*c* is a partial cut-away view of a lower frame of a magnetic contactor to which an auxiliary contact unit according to the present invention is attached and having lower hook insertion grooves, one of the lower hook insertion grooves being located in area B.
Figure 5D:
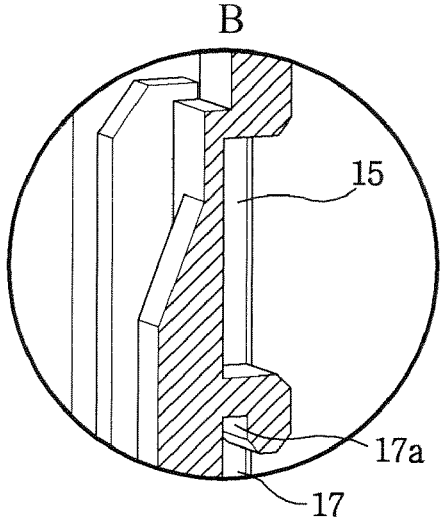
FIG. 5*d* is an enlarged view of area B shown in FIG. 5*c* illustrating the lower hook insertion groove formed with a hitching groove.

Now, referring to FIG. 5*d*, which is an enlarged view of area B shown in FIG. 5*c*, each lower hook insertion groove (17) into which the lower hook (27) is inserted is formed with a hitching groove (17*a*) so that the crooked lower hook is prevented from being easily unhooked once the lower hook is inserted into the groove.

Therefore, if the auxiliary contact unit (20) is attached to the magnetic contactor (10), the upper hook (23) is inserted into the upper hook insertion groove (13) to be hitched at the inclined surface (13*a*) of the upper hook insertion groove, and the lower hook (27) is hitched at the hitching groove (17*a*) to enable the auxiliary contact unit (20) to be securely attached to the magnetic contactor (10).

Figure 6:
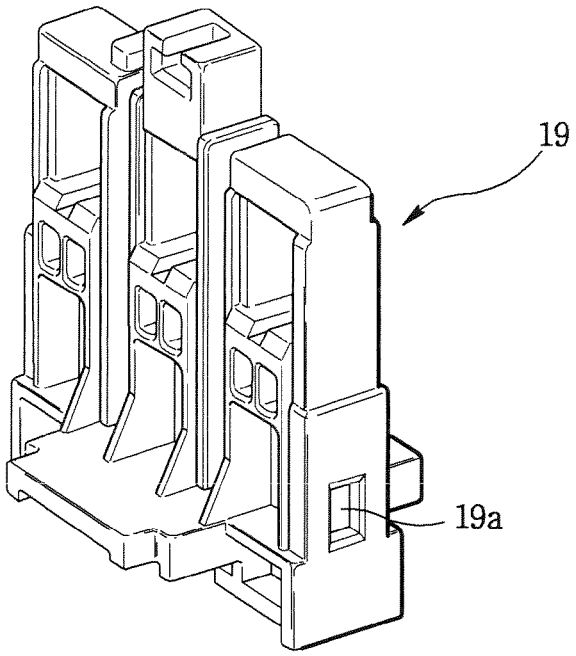
FIG. 6 is a perspective view of a cross-bar disposed within a magnetic contactor to which an auxiliary contact unit is attached according to the present invention.

Meanwhile, the magnetic contactor (10) is insertedly disposed at an inner upper frame thereof with a cross-bar (19) illustrated in FIG. 6.

FIG. 6 is a perspective view of the cross-bar disposed within a magnetic contactor to which an auxiliary contact unit is attached according to the present invention.

Referring to FIG. 6, the cross-bar (19) is laterally formed with a cross-bar lug insertion groove (19*a*) into which the cross-bar lug (21) of the auxiliary contact unit (20) is inserted, and the cross-bar lug insertion groove (19*a*) is situated at a place corresponding to that of the cross-bar lug insertion groove (11) formed at the upper frame of the magnetic contactor when the cross-bar is installed inside the magnetic contactor (10).

Figure 7A:
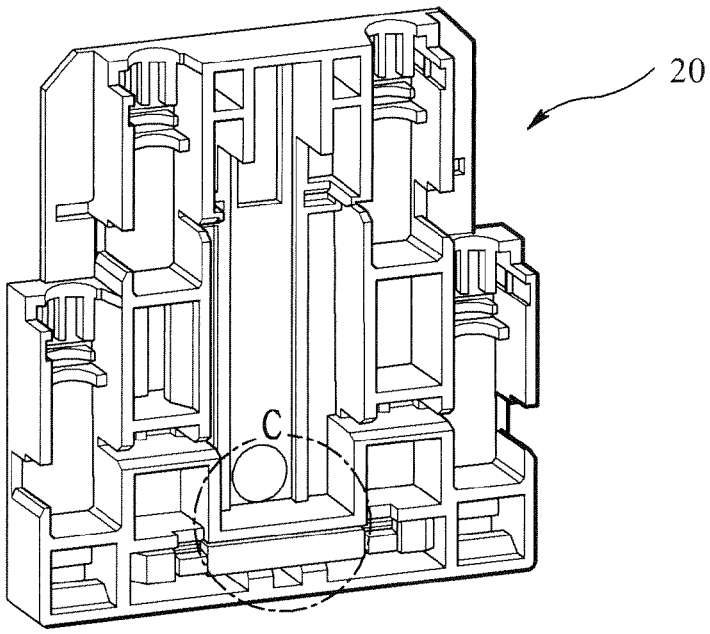
FIG. 7 is an exploded perspective view and partial enlarged view of an auxiliary contact unit according to the present invention.
Figure 7B:
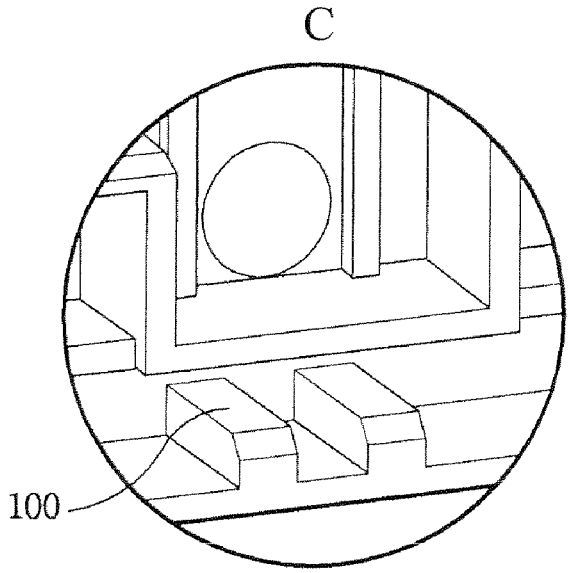
Figure 8:
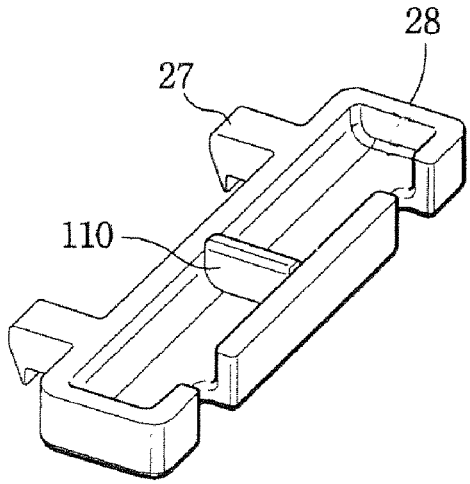
FIG. 8 is a longitudinal cross-sectional view of a lower auxiliary contact unit according to the present invention.

However, as there is a problem of the auxiliary contact unit (20) being weakened in its attachment force to the magnetic contactor (10) due to continued ON/OFF operations of the magnetic contactor (10), a protrusion (100) is installed at a position of a compression spring disposed at a lower end of the auxiliary contact unit (20) as illustrated in FIG. 7 to thereby allow supporting the cover (28 of FIG. 8). Here, FIG. 7 is an exploded perspective view and partial enlarged view of an auxiliary contact unit according to the present invention.

In other words, the compression spring tends to weaken in its elastic force due to frequent ON/OFF operations of the magnetic contactor and lapse of time, such that the protrusion (100) made of elastic material have replaced the compression spring in the present invention, thereby enabling to minimize the weakness of the attachment force of the auxiliary contact unit (20) caused by the decreased elastic force.

Therefore, the elastic force of the crooked lower hook (27) is mainly used for attachment of the auxiliary contact unit (20) to the magnetic contactor (10) in the present invention, whereas elastic force of the cover (28) is employed as an auxiliary thereto. The protrusion (100) serves to support the cover (28) and to allow the cover (28) to maintain a predetermined height lest the cover (28) should droop, such that the cover (28) can be more stably supported than with two or more protrusions formed as shown in the enlarged drawing of FIG. 7.

However, as the scope of right of the present invention is not affected by the number or the position of protrusions, it would make no difference to allow a different type of protrusion (110) to be installed at a lower end of the cover (28) as shown in FIG. 8. In other words, the protrusion may be integrally molded to a lower end of the cover (28), or integrally molded to an inner lower frame of the auxiliary contact unit, to be more specific, to a bottom surface of the lower frame, and may be formed in as many numbers as needed. Here, FIG. 8 is a longitudinal cross-sectional view of a lower auxiliary contact unit according to the present invention.

As apparent from the foregoing, there is an advantage in the auxiliary contact unit for a magnetic contactor according to the present invention thus described in that, unlike the conventional technique, the auxiliary contact unit is structurally changed to thereby remove the comprehension of a cover losing the elastic force as time passes and the ON/OFF operations continue, and the support force of the cover further increases to minimize the weakness of attachment force of the auxiliary contact unit.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

According to the present invention, a molded protrusion replaces a compression spring of the auxiliary contact unit to support a cover, such that there is no problem of the cover losing the elastic force as time passes and the ON/OFF operations of the magnetic contactor continue, and deterioration of the attachment force of the auxiliary contact unit at the magnetic contactor can be minimized as support force of the cover is further improved.

What is claimed is:

1. An auxiliary contact unit for a magnetic contactor, the unit comprising:

a cover disposed inside a lower frame of the auxiliary contact unit and connected to lower hooks, the cover supporting an upper structure of the auxiliary contact unit;

a protrusion formed either at a concave inner surface of the cover, the protrusion supporting the inner surface of the cover, wherein the protrusion is formed as a wall at the inner surface of the cover and the wall is positioned between a first pair of parallel side walls of the cover such that each end portion of the protrusion is in contact with a corresponding one of the first pair of parallel side walls, wherein the wall is further positioned in parallel with a second pair of parallel side walls of the cover, the first and second pairs of parallel side walls being oriented in a vertical direction with respect to one another, and wherein heights of the first and second pairs of parallel side walls are substantially the same.

2. The unit of claim 1, wherein the protrusion supports a central portion of the inner surface of the cover.

3. The unit of claim 1, wherein at least two protrusions are disposed on the inner surface of the cover, the at least two protrusions spaced apart at a predetermined distance in order to distribute force equally onto the inner surface of the cover.

4. The unit of claim 1, wherein the protrusion is made of elastic material.

5. The unit of claim 2, wherein the protrusion is made of elastic material.

6. The unit of claim 3, wherein the at least two protrusions are made of elastic material.

7. The unit of claim 3, wherein sizes of the at least two protrusions are the same.

8. The unit of claim 3, wherein the predetermined distance between the at least two protrusions is the same for all protrusions.

9. The unit of claim 1, further comprising:

a lower hook connected to the cover and inserted into a lower hook insertion groove of the magnetic contactor such that the auxiliary contact unit is attached to the magnetic contactor, the lower hook insertion groove formed with a hitching groove configured to receive the lower hook.

10. The unit of claim 9, wherein the protrusion is made of elastic material and the cover is movable according to elasticity of the protrusion, the lower hook moving in a same direction as a moving direction of the cover.

11. The unit of claim 10, wherein the lower hook comprises a crooked end and is hitched at the hitching groove via the crooked end such that the lower hook is prevented from being disengaged from the lower hook insertion groove when the cover and the lower hook move in the same direction, thus securely attaching the auxiliary contact unit to the magnetic contactor.

12. The unit of claim 1, wherein the protrusion is a single protrusion.

* * * * *